US007189686B2

(12) United States Patent
Burt et al.

(10) Patent No.: US 7,189,686 B2
(45) Date of Patent: Mar. 13, 2007

(54) WATER SOLUBLE SACHET CONTAINING HARD SURFACE CLEANER

(75) Inventors: Diane Joyce Burt, Montvale, NJ (US); Delford Ian Christmas, Montvale, NJ (US); James Chi-Cheng Feng, Montvale, NJ (US); Lucia Krubasik, Montvale, NJ (US); Ralph Gencarelli, Montvale, NJ (US)

(73) Assignee: Reckitt Benckiser Inc., Parsippany, NJ (US)

( * ) Notice: Subject to any disclaimer, the term of this patent is extended or adjusted under 35 U.S.C. 154(b) by 73 days.

(21) Appl. No.: 10/525,936

(22) PCT Filed: Aug. 26, 2003

(86) PCT No.: PCT/GB03/03707

§ 371 (c)(1),
(2), (4) Date: May 11, 2005

(87) PCT Pub. No.: WO2004/020560

PCT Pub. Date: Mar. 11, 2004

(65) Prior Publication Data

US 2006/0172912 A1 Aug. 3, 2006

(30) Foreign Application Priority Data

Aug. 31, 2002 (GB) ..... 0220250.5

(51) Int. Cl.
*C11D 3/48* (2006.01)
*C11D 3/44* (2006.01)
*C11D 1/66* (2006.01)
*C11D 3/30* (2006.01)

(52) U.S. Cl. ..... 510/296; 510/338; 510/382; 510/384; 510/362; 510/363; 510/432; 510/499; 510/475; 510/421

(58) Field of Classification Search ..... 510/296, 510/338, 382, 384, 362, 363, 432, 499, 475, 510/421
See application file for complete search history.

(56) References Cited

U.S. PATENT DOCUMENTS

| | | | | |
|---|---|---|---|---|
| 2,974,134 | A | 3/1961 | Pollitzer | 260/209 |
| 3,219,656 | A | 11/1965 | Boettner | 260/210 |
| 3,265,624 | A | 8/1966 | Inamorato | 252/99 |
| 3,598,865 | A | 8/1971 | Lew | 260/210 |
| 3,640,998 | A | 2/1972 | Mansfield et al. | 260/210 |
| 3,707,535 | A | 12/1972 | Lew | 260/210 |
| 3,772,269 | A | 11/1973 | Lew | 260/210 |
| 3,839,318 | A | 10/1974 | Mansfield | 260/210 |
| 3,974,138 | A | 8/1976 | Lew | 536/4 |
| 4,223,129 | A | 9/1980 | Roth et al. | 536/4 |
| 4,522,738 | A * | 6/1985 | Magid et al. | 510/100 |
| 4,528,106 | A | 7/1985 | Grolitzer | 252/8.55 |
| 4,610,799 | A * | 9/1986 | Wilsberg et al. | 510/296 |
| 5,674,831 | A * | 10/1997 | Schulz et al. | 510/501 |
| 6,037,319 | A * | 3/2000 | Dickler et al. | 510/439 |
| 6,136,776 | A * | 10/2000 | Dickler et al. | 510/439 |
| 2004/0192569 | A1 * | 9/2004 | Colurciello et al. | 510/296 |
| 2004/0259757 | A1 * | 12/2004 | Gladfelter et al. | 510/447 |

FOREIGN PATENT DOCUMENTS

| | | |
|---|---|---|
| EP | A-524-721 | 1/1993 |
| EP | 1 120 459 A | 8/2001 |
| GB | A-2244228 | 11/1991 |
| GB | 2 376 238 A | 12/2002 |
| WO | WO 92/17381 | 10/1992 |
| WO | WO 92/17382 | 10/1992 |
| WO | WO 93/08095 | 4/1993 |
| WO | WO 00/55068 | 9/2000 |

OTHER PUBLICATIONS

International Search Report dated Jan. 29, 2004 for Application No. PCT/GB03/03707.
International Preliminary Examination Report dated Dec. 17, 2004 for Application No. PCT/GB03/03707.
Combined Search and Examination Report from The Patent Office in Great Britain dated Mar. 19, 2003 for Application No. GB 0220250.5.

* cited by examiner

*Primary Examiner*—Charles Boyer
(74) *Attorney, Agent, or Firm*—Norris McLaughlin & Marcus PA

(57) ABSTRACT

The invention relates to a water soluble container which containing concentrate composition useful for hard surface disinfecting and cleaning comprising: (a) at least one cationic surfactant having germicidal properties; (b) at least one non-ionic surfactant; (c) at least one organic solvent having a solubility in water of at least 4% wt.; (d) optionally, at least one alkanolamine; (e) optionally, at least one polyethylene glycol; and (f) optionally, up to about 10% wt. of one or more conventional additives selected from coloring agents, fragrances and fragrance solubilizers, viscosity modifying agents, other surfactants, other antimicrobial/germicidal agents, pH adjusting agents and pH buffers including organic and inorganic salts, optical brighteners, opacifying agents, hydrotropes, antifoaming agents, enzymes, anti-spotting agents, anti-oxidants, preservatives, and anti-corrosion agents; wherein said concentrate composition contains no more than 20% wt. water, and desirably contains less. The water soluble containers can be made by thermoforming or injection molding. Methods for the manufacture of such containers containing the concentrate compositions and methods for the treatment of hard surfaces using the concentrate compositions and especially aqueous dilutions of the concentrate compositions are disclosed.

12 Claims, No Drawings

WATER SOLUBLE SACHET CONTAINING HARD SURFACE CLEANER

This is an application tiled under 35 USC 371 of PCT/GB2003/003707.

The present invention is directed compositions for the treatment of hard surfaces, as well as methods for disinfecting and/or sanitizing of such surfaces, particularly hard surfaces. The present invention relates to hard surface disinfecting compositions, especially compositions which dissolve and disperse satisfactorily in water.

Liquid disinfecting compositions comprising surfactants are known. Such compositions can be used, for example, as hard surface cleaners, in either dilutable form or in ready to use form which in addition to providing a useful detersive effect also provide a disinfecting effect to a treated hard surface. Such compositions do not generally have any compatibility problems when being diluted with a large quantity of water.

For some purposes it is desirable to have liquid disinfecting compositions which are anhydrous or substantially anhydrous. In some instances, when such compositions are anhydrous or substantially anhydrous, pre-measured doses can be prepared so that the user of the these compositions do not have to measure the appropriate amount of surfactant composition to use every time they wish to clean hard surfaces.

Thus, there is real and continuing need in the art for improved compositions which are useful in the cleaning of surfaces, particularly hard surfaces. Particularly there is a real and continuing need in the art for improved hard surface treatment compositions which provide a cleaning or disinfecting benefit, (preferably both) and which overcomes one or more of the shortcomings of prior art hard surface cleaning compositions. Particularly there is a need for further improved hard surface cleaning and/or disinfecting compositions which are effective against a broad spectrum of microorganisms.

The present inventive concentrate composition is especially suitable for use in a water-soluble container where the container is simply added to a large quantity of water and dissolves, releasing its contents. The favorable dissolution and dispersion properties of the concentrate compositions according to the present invention are particularly useful in this context. The present inventive concentrate compositions are suitable for use in a water-soluble container where the said container containing a measured quantity of the concentrate composition is simply added to a large quantity of water and dissolves, releasing its contents and from which a diluted treatment composition is formed, which diluted treatment composition may be used to provide a disinfecting effect to hard surfaces. The favorable dissolution and dispersion properties of the concentrate composition of the present invention are particularly useful in this context.

The present invention also provides a water soluble container containing a hard surface disinfecting concentrate composition, as well as methods for their manufacture and methods for their use.

According to a first aspect of the invention, the present invention relates to a water soluble container containing a concentrate composition comprising (preferably consisting essentially of):

(a) at least one cationic surfactant having germicidal properties;

(b) at least one non-ionic surfactant;

(c) at least one organic solvent having a solubility in water of at least 4% wt.;

(d) optionally, at least one alkanolamine;

(e) optionally, at least one polyethylene glycol; and (f) optionally, up to about 10% wt. of one or more conventional additives selected from coloring agents, fragrances and fragrance solubilizers, viscosity modifying agents, other surfactants, other antimicrobial/germicidal agents, pH adjusting agents and pH buffers including organic and inorganic salts, optical brighteners, opacifying agents, hydrotropes, antifoaming agents, enzymes, anti-spotting agents, anti-oxidants, preservatives, and anti-corrosion agents;

wherein said composition contains no more than 20% wt. water, more preferably containing no more than 15% wt. water, and even more preferably contains no more than 3% wt. water and especially preferably contain no more than 1% wt. water.

According to a second and preferred aspect of the invention there is provided water soluble container containing a concentrate composition according to the first aspect of the invention, wherein the concentrate composition necessarily comprises (d) at least one alkanolamine.

According to a third and preferred aspect of the invention there is provided water soluble container containing a concentrate composition according to the first aspect of the invention, wherein the concentrate composition necessarily comprises (e) at least one polyethylene glycol.

According to a fourth and preferred aspect of the invention there is provided water soluble container containing a concentrate composition according to the first aspect of the invention, wherein the concentrate composition necessarily comprises (d) at least one alkanolamine and (e) at least one polyethylene glycol.

In a fifth and preferred aspect of the invention there is there is provided a concentrate composition according to any of the prior recited inventive aspects wherein (b) at least 70% wt. of at least one organic solvent having a solubility in water of at least 4% wt. comprises (preferably consists essentially of) dipropylene glycol n-butyl ether and dipropylene glycol n-methyl ether.

A sixth and further aspect of the invention is directed to a water soluble container containing a concentrate composition according to any prior recited inventive aspect dissolved in a larger quantity of water to form a diluted composition, wherein said diluted composition provides a germicidal effect to hard surfaces.

A seventh and further aspect of the invention is directed to a process for treating a surface, particularly a hard surface wherein the presence of undesired microorganisms e.g, gram positive type pathogenic bacteria such as *Staphylococcus aureus,* and/or gram negative type pathogenic bacteria such as *Salmonella choleraesuis* and/or *Pseudomonas aeruginosa,* are suspected, comprising the process steps of:

placing a water soluble container containing a concentrate composition according to any of the first through sixth aspects of the invention recited above into a quantity of water;

allowing the water soluble container to dissolve in the water to form a diluted treatment composition;

and applying an effective amount of the diluted treatment composition to the surface in need of treatment in order to provide sanitizing or disinfecting effect thereto.

These and other aspects of the present invention will become more apparent from the following detailed description.

The water-soluble container useful in conjunction with the concentrate compositins may comprise a thermoformed or injection molded water-soluble polymer. It may also simply comprise a water-soluble film. Such containers are described, for example, in EP-A-524,721, GB-A-2,244,258, WO 92/17,381 and WO 00/55,068.

The method of thermoforming the container is similar to the process described in WO 92/17382. A first poly (vinyl alcohol) ("PVOH") film is initially thermoformed to produce a non-planar sheet containing a pocket, such as a recess, which is able to retain the aqueous composition. The pocket is generally bounded by a flange, which is preferably substantially planar. The pocket may have internal barrier layers as described in, for example, WO 93/08095. The pocket is then filled with the aqueous composition, and a second PVOH film is placed on the flange and across the pocket. The second PVOH film may or may not be thermoformed. If the first film contains more than one pocket, the second film may be placed across all of the pockets for convenience. The pocket may be completely filled, or only partly filled, for example to leave an air space of from 2 to 20%, especially from 5 to 10%, of the volume of the container immediately after it is formed. Partial filling may reduce the risk of rupture of the container if it is subjected to shock and reduce the risk of leakage if the container is subjected to high temperatures.

The films are then sealed together, for example by heat sealing across the flange. Other methods of sealing the films together may be used, for example infra-red, radio frequency, ultrasonic, laser, solvent, vibration or spin welding. An adhesive such as an aqueous solution of PVOH may also be used. The seal desirably is also water-soluble.

For injection molding the containers of the present invention, the container or capsule generally comprises a receptacle part which holds the composition and a closure part, which may simply close the receptacle part or may itself have at least some receptacle function. The receptacle part preferably has side walls which terminate at their upper end in an outward flange in which the closure part is sealingly secured, especially if the closure part is in the form of a film. The securement may be by means of an adhesive but is preferably achieved by means of a seal, between the flange and the closure part. Heat sealing may be used or other methods such as infra-red, radio frequency, ultrasonic, laser, solvent, vibration or spin welding. An adhesive such as an aqueous solution of PVOH or a cellulose ether may also be used. The seal is desirably also water-soluble.

The closure part may itself be injection molded or blow molded. Preferably, however, it is a plastic film secured over the receptacle part. The film may, for example, comprise PVOH or a cellulose ether such as HPMC or another water-soluble polymer.

The container walls have thicknesses such that the containers are rigid. For example, the outside walls and any inside walls which have been injection molded independently generally have a thickness of greater than 100 μm, for example greater than 150 μm or greater than 200 μm, 300 μm or 500 μm. Preferably, the closure part is of a thinner material than the receptacle part. Thus, typically, the closure part is of thickness in the range 10 to 200 μm, preferably 50 to 100 μm, and the wall thickness of the receptacle part is in the range 300 to 1500 μm, preferably 500 to 1000 μm. The closure part may, however, also have a wall thickness of 300 to 1500 μm, such as 500 to 1000 μm.

Preferably, the closure part dissolves in water (at least to the extent of allowing the washing composition in the receptacle part to be dissolved by the water; and preferably completely) at 20° C. in less than 3 minutes, preferably in less than 1 minute.

The receptacle part and the closure part could be of the same thickness but in this event the closure part may, for example, be of higher solubility than the receptacle part, in order to dissolve more quickly.

In the manufacturing method, the array, formed by injection molding, is fed to a filling zone, and all the receptacle parts are charged with the washing composition. A sheet of a water-soluble polymer such as PVOH or a cellulose ether may then be secured over the top of the array, to form the closure parts for all the receptacle parts of the array. The array may then be split up into the individual washing capsules, prior to packaging, or it may be left as an array, for packaging, to be split by the user. Preferably, it is left as an array, for the user to break or tear off the individual washing capsules. Preferably, the array has a line of symmetry extending between capsules, and the two halves of the array are folded together, about that line of symmetry, so that closure parts are in face-to-face contact. This helps to protect the closure parts from any damage, between factory and user. It will be appreciated that the closure parts are more prone to damage than the receptacle parts. Alternatively two identical arrays of washing capsules may be placed together with their closure parts in face-to-face contact, for packaging.

In all cases, the polymer is formed into a container or receptacle such as a pouch which can receive the composition, which is filled with the composition and then sealed, for example by heat sealing along the top of the container in vertical form-fill-processes or by laying a further sheet of water-soluble polymer or molded polymer on top of the container and sealing it to the body of the container, for example by heat sealing. Other methods of sealing the films together may be used, for example infra-red, radio frequency, ultrasonic, laser, solvent, vibration or spin welding. An adhesive such as an aqueous solution of PVOH may also be used. The seal desirably is also water-soluble.

Desirably the water-soluble polymer is PVOH. The PVOH may be partially or fully alcoholized or hydrolyzed. For example, it may be from 40 to 100% preferably 70 to 92%, more preferably about 88%, alcoholized or hydrolyzed, polyvinyl acetate. When the polymer is in film form, the film may be cast, blown or extruded.

The water-soluble polymer is generally cold water (20° C.) soluble, but depending on its chemical nature, for example the degree of hydrolysis of the PVOH, may be insoluble in cold water at 20° C., and only become soluble in warm water or hot water having a temperature of, for example, 30° C., 40° C., 50° C. or even 60° C. It is preferable that the water soluble polymer is soluble in cold water.

The water soluble containers of the present invention find particular use where a unit-dosage form of the composition is required which is then diluted prior to use. Thus, for example, the composition may be useful as a hard surface cleaner (for example, floors, bathroom surfaces, windows) which is diluted prior to use. The water soluble container to be used for hard surface cleaners can take any shape, such as an envelope, sachet, sphere, cylinder, cube or cuboid (i.e. a rectangular parallelepiped whose faces are not all equal) where the base is square, circular, triangular, or oval, but water soluble containers of rounded cuboid or cylindrical shape are preferred; rounded cuboid for use in, for example, a bucket of water and cylindrical when used as a refill for a trigger bottle. For the rounded cuboid water soluble container, the water soluble container can have dimensions such as, for example, having a length of 1 to 5 cm, especially 3.5 to 4.5 cm, a width of 1.5 to 3.5 cm, especially 2 to 3 cm, and a height of 1 to 2 cm, especially 1.25 to 1.75 cm. The water-soluble container may hold, for example, from 10 to 40 g of the composition, especially from 15 to 25 g of the composition of the present composition. For the cylindrical shape, the water soluble container diameter should be such that the water soluble container fits through the opening of a trigger bottle, generally about 2 cm. The length of the water soluble container can be about 1 to 8 cm. Such water soluble containers hold about 3 to about 25 g of composition. However, it should be understood that there is no theoretical limitation, in either size or shape, and what is suitable will normally be decided upon the basis of the "dose" of the water soluble container's contents, the size of any aperture the water soluble container may have to pass through, and the available means of delivery.

In some embodiments, a single layer film for both the top and bottom the packet can be used or a laminate film of two or more layers of PVOH or other water soluble film can be used on either the top or bottom or on both top and bottom of the packet. For the cylindrical container, the film can also be single layer or a laminate of two or more layers of PVOH or other water soluble film.

The water soluble container can comprise a thermoformed or injection molded water soluble polymer.

An essential constituents of the concentrate compositions of the invention are is (a) at least one cationic surfactant having germicidal properties is present. By way of non-limiting example, useful cationic surfactants having germicidal properties may be one or more of those described in, for example, *McCutcheon's Detergents and Emulsifiers,* North American and International Editions, 2001; *Kirk-Othmer, Encyclopedia of Chemical Technology,* 4th Ed., Vol. 23, pp. 478–541, the contents of which are herein incorporated by reference. Exemplary cationic surfactant compositions which provide a germicidal effect particularly useful in the concentrate compositions, include those which may be characterized by the general structural formula:

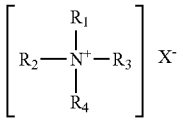

where at least one of $R_1$, $R_2$, $R_3$ and $R_4$ is an alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the above mentioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex.

Examples of quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other examples of quaternary ammonium salts include those in which the molecule contains either amide, ether or ester linkages such as octyl phenoxy ethoxy ethyl dimethyl benzyl ammonium chloride, N-(lauryloxycoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylphenyltrimethyl ammonium chloride, chlorinated dodecylbenzyltrimethyl ammonium chloride, and the like.

Further examples of quaternary ammonium compounds within the above description include those which have the structural formula:

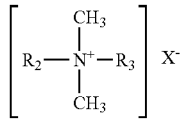

wherein $R_2$ and $R_3$ are the same or different $C_8$–$C_{12}$ alkyl, or $R_2$ is $C_{12-16}$ alkyl, $C_{8-18}$alkylethoxy, $C_{8-18}$alkylphenoxyethoxy and $R_3$ is benzyl, and X is a halide, for example chloride, bromide or iodide, or is a methosulfate or saccharinate anion. The alkyl groups recited in $R_2$ and $R_3$ may be straight-chained or branched, but are preferably substantially linear.

Exemplary useful quaternary germicides include compositions which include a single quaternary compound, as well as mixtures of two or more different quaternary compounds. Such useful quaternary compounds are available under the BARDAC®, BARQUAT®, HYAMINE®, CATIGENE, LONZABAC®, BTC®, ONYXIDE®, and PRAEPAGEN® trademarks, which are more fully described in, for example, *McCutcheon's Functional Materials,* North American and International Editions, 2001, and the respective product literature from the suppliers identified below. For example, BARDAC® 205M is described to be a liquid containing alkyl dimethyl benzyl ammonium chloride, octyl decyl dimethyl ammonium chloride; didecyl dimethyl ammonium chloride, and dioctyl dimethyl ammonium chloride (50% active) (also available as 80% active (BARDAC® 208M)); described generally in *McCutcheon's* as a combination of alkyl dimethyl benzyl ammonium chloride and dialkyl dimethyl ammonium chloride); BARDAC® 2050 is described to be a combination of octyl decyl dimethyl ammonium chloride/didecyl dimethyl ammonium chloride, and dioctyl dimethyl ammonium chloride (50% active) (also available as 80% active (BARDAC® 2080)); BARDAC® 2250 is described to be didecyl dimethyl ammonium chloride (50% active); BARDAC® LF (or BARDAC® LF-80), described as being based on dioctyl dimethyl ammonium chloride (BARQUAT® MB-50, MX-50, OJ-50 (each 50% liquid) and MB-80 or MX-80 (each 80% liquid) are each described as an alkyl dimethyl benzyl ammonium chloride; BARDAC® 4250 and BARQUAT® 4250Z (each 50% active) or BARQUAT® 4280 and BARQUAT® 4280Z (each 80% active) are each described as alkyl dimethyl benzyl ammonium chloride/alkyl dimethyl ethyl benzyl ammonium chloride; and BARQUAT® MS-100 described as being a mixture of tetradecyl dimethyl benzyl ammonium chloride/dodecyl dimethyl benzyl ammonium chloride/hexadecyl dimethyl benzyl ammonium chloride (100% solid (powder)). Also, HYAMINE® 1622, described as diisobutyl phenoxy ethoxy ethyl dimethyl benzyl ammonium chloride (available either as 100% actives or as a 50% actives solution); HYAMINE® 3500 (50% actives), described as alkyl dimethyl benzyl ammonium chloride (also available as 80% active (HYAMINE® 3500–80); and HYAMINE® 2389 described as being based on methyldodecylbenzyl ammonium chloride and/or methyldodecylxylene-bis-trimethyl ammonium chloride. (BARDAC®, BARQUAT® and HYAMINE® are presently commercially available from Lonza, Inc., Fairlawn, N.J.). BTC® 50 NF (or BTC® 65 NF) is described to be alkyl dimethyl benzyl ammonium chloride (50% active); BTC® 99 is described as didecyl dimethyl ammonium chloride (50% active); BTC® 776 is described to be myristalkonium chloride (50% active); BTC® 818 is described as being octyl decyl dimethyl ammonium chloride, didecyl dimethyl ammonium chloride, and dioctyl dimethyl ammonium chloride (50% active) (available also as 80% active (BTC® 818-80%)); BTC® 824 and BTC® 835 are each described as being of alkyl dimethyl benzyl ammonium chloride (each 50% active); BTC® 885 is described as a combination of BTC® 835 and BTC® 818 (50% active) (available also as 80% active (BTC® 888)); BTC® 1010 is described as didecyl dimethyl ammonium chloride (50% active) (also available as 80% active (BTC® 1010-80)); BTC® 2125 (or BTC® 2125 M) is described as alkyl dimethyl benzyl ammonium chloride and alkyl dimethyl ethylbenzyl ammonium chloride (each 50% active) (also available as 80% active (BTC® 2125-80 or BTC® 2125 M)); BTC® 2565 is described as alkyl dimethyl benzyl ammonium chlorides (50% active) (also available as 80% active (BTC® 2568)); BTC® 8248 (or BTC® 8358) is described as alkyl dimethyl benzyl ammonium chloride (80% active) (also available as 90% active (BTC® 8249)); ONYXIDE® 3300 is described as n-alkyl dimethyl benzyl ammonium saccharinate (95% active). CATIGENE series is described as mixtures of alkyl dimethyl benzyl ammonium chlorides/alkyl dimethyl ethyl benzyl ammonium chlorides/dialkyl dimethyl ammonium chlorides. (BTC®, ONYXIDE®, and CATIGENE are presently commercially available from Stepan Company, Northfield, Ill. (CATIGENE from Stepan Europe)). Another example of a cationic surfactant is Praepagen HY, described as n-alkyl ($C_{12-14}$) dimethyl 2-hydroxyethyl ammonium chloride from Clariant. Another example of a cationic surfactant is Rewoquat CQ100 (Degussa), which is reported to be a blend of a quaternary ammonium compound and an ethoxylated fatty alcohol. Polymeric quaternary ammonium salts based on these monomeric structures are also considered desirable for the present invention. One example is POLYQUAT®, described as being a 2-butenyldimethyl ammonium chloride polymer.

With regard to the effective amounts of the (a) at least one cationic surfactant having germicidal properties, it may be present in any amount which imparts an effective germicidal effect when the concentrate composition is applied directly to a surface in need of disinfection, or when the concentrate composition if first diluted in a volume of water and this dilution is then applied to a surface in need of disinfection. Desirably, it is present so that when the concentrate composition is diluted in water, the (a) at least one cationic surfactant having germicidal properties should be ultimately be present in an amount of from 100 to 2000 ppm (parts per million) but desirably at least about 200 ppm in such a dilution. Such an amount is generally effective in the sanitization of surfaces wherein a dilution is permitted a contact time of 10 minutes. Of course it is to be understood that greater dilutions may also be effective by permitting a longer contact time. Generally the amount of at least one cationic surfactant having germicidal properties present in the inventive concentrate composition ranges from about 0.01 to about 20% wt. It should be noted that for any cationic surfactants which are not supplied as 100 percent active, the cationic surfactant should be provided in a non-aqueous solvent or if supplied containing some water, the total amount of water present should be such that when placed within the composition of the present invention, the total amount of water does not exceed 1% wt.

The concentrate compositions according to the present invention necessarily comprise (b) at least one nonionic surfactant is used in the composition. Nonlimiting examples of suitable nonionic surfactants which may be used in the present invention include:

(1) The polyethylene oxide condensates of alkyl phenols. These compounds include the condensation products of alkyl phenols having an alkyl group containing from about 6 to 12 carbon atoms in either a straight chain or branched chain configuration with ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

(2) The condensation products of aliphatic alcohols with from about 1 to about 60 moles of ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). One example of such a nonionic surfactant is available as Empilan KM 50.

(3) Alkoxy block copolymers, and in particular, compounds based on ethoxy/propoxy block copolymers. Polymeric alkylene oxide block copolymers include nonionic surfactants in which the major portion of the molecule is made up of block polymeric $C_2$–$C_4$ alkylene oxides. Such nonionic surfactants, while preferably built up from an alkylene oxide chain starting group, and can have as a starting nucleus almost any active hydrogen containing group including, without limitation, amides, phenols, thiols and secondary alcohols.

Other nonionic surfactants containing the characteristic alkylene oxide blocks are those which may be generally represented by the formula (A):

$$HO—(EO)_x(PO)_y(EO)_z—H \quad (A)$$

where EO represents ethylene oxide,

PO represents propylene oxide, y equals at least 15, $(EO)_{x+y}$ equals 20 to 50% of the total weight of said compounds, and, the total molecular weight is preferably in the range of about 2000 to 15,000. These surfactants are available under the PLURONIC tradename from BASF or Emulgen from Kao.

Another group of nonionic surfactants can be represented by the formula (B):

$$R—(EO,PO)_a(EO,PO)_b—H \quad (B)$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000–5000.

Still further nonionic surfactants containing polymeric butoxy (BO) groups can be represented by formula (C) as follows:

$$RO—(BO),(BO)_n(EO)_x—H \quad (C)$$

wherein R is an alkyl group containing 1 to 20 carbon atoms, n is about 5–15 and x is about 5–15.

Yet further nonionic block copolymer surfactants, which also include polymeric butoxy groups, are those which may be represented by the following formula (D):

$$HO—(EO)_x(BO)_n(EO)_y—H \quad (D)$$

wherein n is about 5–15, preferably about 15, x is about 5–15, preferably about 15, and y is about 5–15, preferably about 15.

Still further nonionic block copolymer surfactants include ethoxylated derivatives of propoxylated ethylene diamine, which may be represented by the following formula:

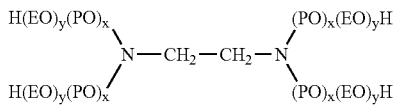

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Other examples of non-ionic surfactants include linear alcohol ethoxylates. The linear alcohol ethoxylates which may be employed in the present invention are generally include the $C_6$–$C_{15}$ straight chain alcohols which are ethoxylated with about 1 to 13 moles of ethylene oxide.

By way of non-limiting example, useful alcohol ethoxylates include Alfonic® 810-4.5, which is described in product literature from Sasol North America Inc. as having an average molecular weight of 356, an ethylene oxide content of about 4.85 moles (about 60 wt. %), and an HLB of about 12; Alfonic® 810-2, which is described in product literature from Sasol North America Inc. as having an average molecular weight of 242, an ethylene oxide content of about 2.1 moles (about 40 wt. %), and an HLB of about 12; and Alfonic® 610-3.5, which is described in product literature from Sasol North America Inc. as having an average molecular weight of 276, an ethylene oxide content of about 3.1 moles (about 50 wt. %), and an HLB of 10. Product literature from Sasol North America Inc. also identifies that the numbers in the alcohol ethoxylate name designate the carbon chain length (numbers before the hyphen) and the average moles of ethylene oxide (numbers after the hyphen) in the product. These examples are typically $C_6$–$C_{11}$ straight-chain alcohols which are ethoxylated with from about 3 to about 6 moles of ethylene oxide. Further examples of ethoxylated alcohols include the Neodol® 91 series non-ionic surfactants available from Shell Chemical Company which are described as $C_9$–$C_{11}$ ethoxylated alcohols. The Neodol® 91 series non-ionic surfactants of interest include Neodol 91-2.5, Neodol 91-6, and Neodol 91-8. Neodol 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Still further examples of ethoxylated alcohols include the Rhodasurf® DA series non-ionic surfactants available from Rhodia which are described to be branched isodecyl alcohol ethoxylates. Rhodasurf DA-530 has been described as having 4 moles of ethoxylation and an HLB of 10.5; Rhodasurf DA-630 has been described as having 6 moles of ethoxylation with an HLB of 12.5; and Rhodasurf DA-639 is a 90% solution of DA-630. Yet further examples of ethoxylated alcohols include those from Tomah Products (Milton, Wis.) under the Tomadol tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear C9/C10/C11 and n is 2.5, 6, or 8; 1-3; 1-5; 1-7; 1-73B; 1-9;—where R is linear C11 and n is 3, 5, 7 or 9; 23-1; 23-3; 23-5; 23-6.5—where R is linear C12/C13 and n is 1, 3, 5, or 6.5; 25-3; 25-7; 25-9; 25-12—where R is linear C12/C13 C14/C15 and n is 3, 7, 9, or 12; and 45-7; 45-13—where R is linear C14/C15 and n is 7 or 13.

Another class of non-ionic surfactants include amine oxide compounds. Examples of amine oxide compounds may be defined as one or more of the following of the four general classes:

(1) Alkyl di (lower alkyl) amine oxides in which the alkyl group has about 6–24, and preferably 8–18 carbon atoms, and can be straight or branched chain, saturated or unsaturated. The lower alkyl groups include between 1 and 7 carbon atoms, but preferably each include 1–3 carbon atoms. Examples include octyl dimethyl amine oxide, lauryl dimethyl amine oxide, myristyl dimethyl amine oxide, and those in which the alkyl group is a mixture of different amine oxides, such as dimethyl cocoamine oxide, dimethyl (hydrogenated tallow) amine oxide, and myristyl/palmityl dimethyl amine oxide;

(2) Alkyl di (hydroxy lower alkyl) amine oxides in which the alkyl group has about 6–22, and preferably 8–18 carbon atoms, and can be straight or branched chain, saturated or unsaturated. Examples include bis-(2-hydroxyethyl) cocoamine oxide, bis-(2-hydroxyethyl) tallowamine oxide; and bis-(2-hydroxyethyl) stearylamine oxide;

(3) Alkylamidopropyl di(lower alkyl) amine oxides in which the alkyl group has about 10–20, and preferably 12–16 carbon atoms, and can be straight or branched chain, saturated or unsaturated. Examples are cocoamidopropyl dimethyl amine oxide and tallowamidopropyl dimethyl amine oxide; and (4) Alkylmorpholine oxides in which the alkyl group has about 10–20, and preferably 12–16 carbon atoms, and can be straight or branched chain, saturated or unsaturated.

Two or more amine oxides may be used, wherein amine oxides of varying chains of the $R_2$ group are present. Examples of amine oxide compounds include N-alkyl dimethyl amine oxides, particularly octyl dimethyl amine oxides as well as lauryl dimethyl amine oxide. These amine oxide compounds are available as surfactants from McIntyre Group Ltd. under the tradename Mackamine® as well as from Stepan Co., under the tradename Ammonyx®.

Useful in the concentrate compositions according to the invention as the (b) at least one nonionic surfactant is an alkyl polyglycoside. Suitable alkyl polyglycosides are known nonionic surfactants which are alkaline and electrolyte stable. Alkyl mono and polyglycosides are prepared generally by reacting a monosaccharide, or a compound hydrolyzable to a monosaccharide with an alcohol such as a fatty alcohol in an acid medium. Various glycoside and polyglycoside compounds including alkoxylated glycosides and processes for making them are disclosed in U.S. Pat. Nos. 2,974,134; 3,219,656; 3,598,865; 3,640,998; 3,707,535; 3,772,269; 3,839,318; 3,974,138; 4,223,129; and 4,528,106.

A preferred group of alkyl glycoside surfactants suitable for use in the practice of this invention may be represented by formula I below:

$$RO—(R_1O)_y—(G)_xZ_b \qquad \text{I}$$

wherein:

R is a monovalent organic radical containing from about 6 to about 30, preferably from about 8 to about 18 carbon atoms;

$R_1$ is a divalent hydrocarbon radical containing from about 2 to about 4 carbon atoms;

O is an oxygen atom;

y is a number which has an average value from about 0 to about 1 and is preferably 0;

G is a moiety derived from a reducing saccharide containing 5 or 6 carbon atoms; and x is a number having an average value from about 1 to 5 (preferably from 1.1 to 2);

Z is $O_2M^1$,

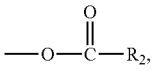

$O(CH_2)$, $CO_2M^1$, $OSO_3M^1$, or $O(CH_2)SO_3M^1$; $R_2$ is $(CH^2)CO_2M^1$ or $CH{=}CHCO_2M^1$; (with the proviso that Z can be $O_2M^1$ only if Z is in place of a primary hydroxyl group in which the primary hydroxyl-bearing carbon atom, —$CH_2OH$, is oxidized to form a

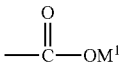

group);

b is a number of from 0 to 3x+1 preferably an average of from 0.5 to 2 per glycosal group;

p is 1 to 10, $M^1$ is $H^+$ or an organic or inorganic cation, such as, for example, an alkali metal, ammonium, monoethanolamine, or calcium.

As defined in Formula I above, R is generally the residue of a fatty alcohol having from about 8 to 30 and preferably 8 to 18 carbon atoms. Examples of such alkylglycosides as described above include, for example, APG™ 325 CS GLYCOSIDE which is described as being a 50% $C_9$–$C_{11}$ alkyl polyglycoside, also commonly referred to as D-glucopyranoside, (commercially available from Henkel Corp, Ambler Pa.) and GLUCOPON™ 625 CS which is described as being a 50% $C_{10}$–$C_{16}$ alkyl polyglycoside, also commonly referred to as a D-glucopyranoside, (available from Henkel Corp., Ambler Pa.).

The (b) at least one non-ionic surfactant is present in the inventive composition in an amount of from about 0.01 to about 40% wt., with more preferred weight ranges described with reference to one or more of the Examples.

A further essential constituent of the concentrate compositions of the invention is (c) at least one organic solvent having a solubility in water of at least 4% wt. Examples of organic solvents which may be included in the inventive compositions include those which are at least partially water-miscible such as alcohols (e.g., low molecular weight alcohols, such as, for example, ethanol, propanol, isopropanol, and the like), glycols (such as, for example, ethylene glycol, propylene glycol, hexylene glycol, and the like), water-miscible ethers (e.g. diethylene glycol diethyl ether, diethylene glycol dimethyl ether, propylene glycol dimethyl ether), water-miscible glycol ethers (having the formula $R_a$—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units. Examples include propylene glycol monomethyl ether, propylene glycol monoethyl ether, propylene glycol monopropyl ether, propylene glycol monobutyl ether, propylene glycol isobutyl ether, ethylene glycol monobutyl ether, dipropylene glycol monomethyl ether, diethyleneglycol monobutyl ether (commercially available from Dow Chemical Co. (Midland, Mich.)), and lower esters of monoalkylethers of ethylene glycol or propylene glycol (e.g. propylene glycol monomethyl ether acetate (commercially available from Dow Chemical Co. (Midland, Mich.)). Mixtures of several organic solvents can also be used.

The amount of at least one organic solvent in the inventive compositions ranges from about 5 to about 97% wt., preferably amounts of at least 40% wt. of the concentrate compositions of which they form a part. Particularly preferred organic solvent constituents and particularly preferred amounts are recited with reference to the Examples.

A further optional but in certain particularly preferred embodiments, both a preferred and essential constituent is (d) at least one alkanolamine. Exemplary useful alkanolamines include monoalkanolamines, dialkanolamines, trialkanolamines, and alkylalkanolamines such as alkyl-dialkanolamines, and dialkyl-monoalkanolamines. The alkanol and alkyl groups are generally short to medium chain length, that is, from 1 to 7 carbons in length. For di- and trialkanolamines and dialkyl-monoalkanolamines, these groups can be combined on the same amine to produce for example, methylethylhydroxypropylhydroxylamine. The alkanolamine constituent, when present, comprises from 0.01 to about 10.0% wt. of the inventive compositions. Particularly preferred (e) alkanolamines and particularly preferred amounts are recited with reference to the Examples.

A still further optional constituent but in certain particularly preferred embodiments, a preferred and essential constituent is (e) at least one polyethylene glycol. When present, the (e) polyethylene glycol has a molecular weight from about 100 to about, 4000, preferably 400 to 1000 and most preferably those having a molecular weight of about 600 to 1000 being especially preferred. The polyethylene glycol, when present in the inventive compositions, is present in an amount of from about 2% wt. to about 75% wt. based on the total weight of the concentrate compositions of which they form a part. Particularly preferred (e) polyethylene glycols and particularly preferred amounts are recited with reference to the Examples.

The concentrate compositions of the present invention (f) optionally, up to about 10% wt. of one or more conventional additives selected from coloring agents, fragrances and fragrance solubilizers, viscosity modifying agents, other surfactants, other antimicrobial/germicidal agents, pH adjusting agents and pH buffers including organic and inorganic salts, optical brighteners, opacifying agents, hydrotropes, antifoaming agents, enzymes, anti-spotting agents, anti-oxidants, preservatives, and anti-corrosion agents. When one or more of the optional constituents is added, i.e., fragrance and/or coloring agents, the esthetic and consumer appeal of the product is often favorably improved. The use and selection of these optional constituents is well known to those of ordinary skill in the art, and they should be selected so as to not deleteriously interfere with the function of one or more of the other constituents present in the inventive compositions. Such materials are described, for example in *McCutcheon's Detergents and Emulsifiers,* Vol. 1, North American Edition, 1991; as well as in *McCutcheon's Functional Materials,* Vol. 2, North American Edition, 1991, the contents of which are herein incorporated by reference. Particularly preferred weight ranges, as well as the identity of particularly preferred optional constituents are described with reference to the Examples.

As noted previously, preferred concentrate compositions useful in conjunction with the water soluble containers of the invention may be produced with various amounts of water in amount of no more than 20% wt. water, more preferably containing no more than 15% wt. water, and even more preferably contains no more than 3% wt. water and especially preferably contain no more than 3% wt. water and particularly no more than 1% wt. water. Compositions where water does not exceed 3% wt. and especially 1% wt. provide highly concentrated compositions which may diluted in larger quantities of water to form a cleaning composition therefrom without the loss of disinfecting efficacy in view of the risk of slight overdilution of the concentrate. Concentrate compositions which contain about 15% wt. water are have however surprisingly been found to be useful with the preferred water soluble containers of the invention and notwithstanding the relatively higher amounts water present. Even with such higher amounts of water, e.g, 15% wt., and in some cases even 20% wt. in the concentrate compositions, useful water soluble containers which contain such concentrate compositions may be formed without undue degradation of the PVOH film even under several weeks storage. Water is not normally necessarily added to the compositions and frequently is provided to the inventive compositions as the aqueous carrier portion of one or more of the constituents used to form a composition. However, where the addition of water is necessary it may be filtered water, but more preferably is distilled or deionized water.

In use, a water soluble container containing the concentrate composition can be placed into a spray bottle which uses a dip tube and trigger assembly to dispense a liquid, an amount of water (usually from about 16 to 32 ounces, depending upon the bottle and size of the water soluble container) is added to the bottle wherein the water soluble container starts to dissolve. The dip tube with trigger assembly is then reattached to the bottle and the diluted treatment composition formed therein is ready for use. The resulting diluted treatment composition can be used to treat a variety of surfaces, examples of which are described above. In addition, the water soluble container can also be used in conjunction with cleaning systems which comprise a handle, a cleaning head, and a fluid reservoir wherein the fluid reservoir is attached to the handle or to the cleaning head such that the fluid in the reservoir is dispensed onto a surface to be cleaned adjacent to the cleaning head. In use, the water-soluble container is placed into the fluid reservoir, the requisite amount of water is added to the reservoir and the water soluble container dissolves, releasing the concentrate composition contained therein to be released into the reservoir. The diluted treatment composition is then ready to use by a consumer in the disinfecting and optionally cleaning of a hard surface.

The concentrate compositions of the invention are useful in forming disinfecting compositions for the treatment of hard surfaces by dissolving the concentrate composition contained in the water soluble containers in a larger quantity of water to form a diluted treatment composition therefrom. Most simply the water soluble container containing the concentrate composition is supplied to the larger quantity of water and the water soluble container is allowed to dissolve and thereby release the concentrate composition into the larger quantity of water. The concentrate composition may be dissolved in any larger quantity of water, and advantageously in respective vol/vol ratios of 1:40, preferably 1:45, more preferably 1:50 and most preferably at least 1:60 parts of the concentrate composition:parts water. A particularly preferred dissolution ratio of the concentrate composition to water is about 15 ml per 800 ml to about 1000 ml water, especially 15 ml concentrate to about 900 ml water. The water used to form the diluted treatment composition may be tap water, filtered water, distilled water or deionized water. Excellent cleaning results have been observed even in the presence of modest amounts of inorganic salts in the water, e.g., "hard water" used to form a cleaning composition therefrom.

It is of course to be understood that while the concentrate compositions are advantageously used to form diluted treatment composition therefrom, the concentrate compositions may be used without further aqueous dilution directly in the treatment of hard surfaces.

The concentrate compositions and the diluted compositions according to the invention are useful in the disinfecting and/or cleaning of surfaces, especially hard surfaces in need of such treatment. These in particular include surfaces wherein the presence of gram positive and/or gram negative bacteria are suspected. In accordance with the present inventive process, cleaning and/or disinfecting of such surfaces comprises the steps of placing one or more water soluble containers which contains a composition of the concentrate compositions according to the invention into a container containing an amount of water (for example, spray bottle with dip tube, a bucket) and allowing the container to dissolve, and then applying an effective amount of a com position as taught herein, by sponging, mopping, scrubbing, or spraying, to such a stained surface. Afterwards, the compositions are optionally but desirably wiped, scrubbed or otherwise physically contacted with the hard surface, and further optionally, may be subsequently rinsed from such a cleaned and disinfected hard surface.

By way of example, hard surfaces include surfaces composed of refractory materials such as: glazed and unglazed tile, porcelain, ceramics as well as stone including marble, granite, and other stones surfaces; glass; metals; plastics e.g. polyester, vinyl; fiberglass, Formica®, Corian®, wood, and other hard surfaces known to the industry. Hard surfaces which are to be particularly denoted are lavatory fixtures such as shower stalls, bathtubs and bathing appliances (racks, shower doors, shower bars) toilets, bidets, wall and flooring surfaces especially those which include refractory materials and the like. Further hard surfaces which are to be denoted are those associated with kitchen environments and other environments associated with food preparation, including cabinets and countertop surfaces as well as walls and floor surfaces especially those which include refractory materials, plastics, Formica®, Corian® and stone.

EXAMPLES

Preparation of Example Formulations:

Exemplary formulations illustrating certain embodiments, including preferred embodiments of the inventive compositions and described in more detail in Table 1 below were formulated generally by adding the components into a suitably sized vessel in no particular order and at room temperature. If any of the components are solid, thick or gel-like at room temperature, they can be warmed to render them pourable liquids prior to addition to the vessel. Mixing of the constituents was achieved by the use of a mechanical stirrer with a small diameter propeller at the end of its rotating shaft. Mixing, which generally lasted from 5 minutes to 120 minutes was maintained until the particular exemplary formulation appeared to be homogeneous. The exemplary compositions were readily pourable, and retained well mixed characteristics (i.e., stable mixtures) upon standing for extend periods.

Example concentrate compositions according to the invention are listed on Table 1.

TABLE 1

| Component | Ex. 1 | Ex. 2 | Ex. 3 | Ex. 4 | Ex. 5 | Ex. 6 | Ex. 7 | Ex. 8 |
|---|---|---|---|---|---|---|---|---|
| PEG 600 | 59.60 | 48.6 | 24.60 | 37.60 | 72.60 | 54.45 | 71.73 | 30.73 |
| Bardac 208M | 6.40 | 6.40 | 6.40 | 6.40 | 6.40 | 6.32 | 6.32 | 6.32 |
| Tomadol 45-7 | 7.00 | 7.00 | 7.00 | 7.00 | 7.00 | 6.92 | 6.92 | 6.92 |
| IPA | 15.00 | 8.50 | 15.00 | 2.00 | 2.00 | 1.98 | 1.98 | 8.40 |
| Dowanol PnB | 5.00 | 13.75 | 22.50 | 22.50 | 5.00 | 13.58 | 4.94 | 22.23 |
| Dowanol PM | 5.00 | 13.75 | 22.50 | 22.50 | 5.00 | 13.58 | 4.94 | 22.23 |
| MEA | 2.00 | 2.00 | 2.00 | 2.00 | 2.00 | 1.98 | 1.98 | 1.98 |
| Fragrance | — | — | — | — | — | 1.19 | 1.19 | 1.19 |
| Total | 100.00 | 100.00 | 100.00 | 100.00 | 100.00 | 100.00 | 100.00 | 100.00 |

| Component | Ex. 9 | Ex. 10 | Ex. 11 | Ex. 12 | Ex. 13 | Ex. 14 | Ex. 15 | Ex. 16 |
|---|---|---|---|---|---|---|---|---|
| PEG 600 | 58.89 | 56.59 | 71.73 | 65.30 | 65.30 | 66.30 | 47.30 | 28.30 |
| Bardac 208M | 6.32 | 6.32 | 6.32 | — | — | — | — | — |
| BTC 8358 | — | — | — | 12.50 | 12.50 | 12.50 | 12.50 | 12.50 |
| Tomadol 45-7 | 6.92 | 6.92 | 6.92 | 7.00 | — | — | — | — |
| Tomadol 91-6 | — | — | — | — | 7.00 | 8.00 | 7.00 | 7.00 |
| IPA | 14.82 | 8.40 | 1.98 | 2.00 | 2.00 | 2.00 | 1.00 | 1.00 |
| Dowanol DPnB | — | — | — | 5.00 | 5.00 | 4.00 | 25.00 | 40.00 |
| Dowanol PnB | 4.94 | 9.30 | 4.94 | — | — | — | — | — |
| Dowanol DPM | — | — | — | — | — | — | — | 5.00 |
| Dowanol PM | 4.94 | 9.30 | 4.94 | 5.00 | 5.00 | 4.00 | 1.00 | |
| MEA | 1.98 | 1.98 | 1.98 | 2.00 | 2.00 | 2.00 | 5.00 | 5.00 |
| Fragrance | 1.19 | 1.19 | 1.19 | 1.20 | 1.20 | 1.20 | 1.20 | 1.20 |
| Total | 100.00 | 100.00 | 100.00 | 100.00 | 100.00 | 100.00 | 100.00 | 100.00 |

| Component | Ex. 17 | Ex. 18 | Ex. 19 | Ex. 20 | Ex. 21 | Ex. 22 | Ex. 23 | Ex. 24 |
|---|---|---|---|---|---|---|---|---|
| PEG 600 | 42.30 | 29.30 | 17.30 | 47.30 | 19.30 | 17.50 | 2.30 | 14.30 |
| BTC 8358 | 12.50 | 12.50 | 12.50 | 12.50 | 12.50 | 12.50 | 12.50 | 12.50 |
| Tomadol 91-6 | 7.00 | 7.00 | 7.00 | 7.00 | 40.00 | 28.00 | 7.00 | 20.00 |
| IPA | 1.00 | — | 2.00 | 1.00 | 2.00 | 2.00 | — | 2.00 |
| Dowanol DPnB | 30.00 | 40.00 | 45.00 | 25.00 | 25.00 | 40.00 | 45.00 | 40.00 |
| Dowanol DPM | — | 5.00 | 5.00 | 1.00 | — | — | 30.00 | 5.00 |
| Dowanol PM | 1.00 | — | — | — | — | — | — | — |
| MEA | 5.00 | 5.00 | 10.00 | 5.00 | — | — | 2.00 | 5.00 |
| Fragrance | 1.20 | 1.20 | 1.20 | 1.20 | 1.20 | 1.20 | 1.20 | 1.20 |
| Total | 100.00 | 100.00 | 100.00 | 100.00 | 100.00 | 100.00 | 100.00 | 100.00 |

| Component | Ex. 25 | Ex. 26 | Ex. 27 | Ex. 28 | Ex. 29 | Ex. 30 |
|---|---|---|---|---|---|---|
| PEG 600 | 24.30 | 27.30 | 32.30 | 25.30 | 9.30 | 10.38 |
| BTC 8358 | 12.50 | 12.50 | 12.50 | 12.50 | 12.50 | 12.35 |
| Ammonyx LO | 7.00 | — | — | — | — | — |
| Alfonic 810-4.5 | — | — | — | — | — | 34.58 |

TABLE 1-continued

| | | | | | | |
|---|---|---|---|---|---|---|
| Tomadol 91-6 | — | 14.00 | 14.00 | 7.00 | 35.00 | — |
| IPA | — | — | — | 1.00 | 2.00 | 1.98 |
| Dowanol DPnB | 40.00 | 40.00 | 40.00 | 20.00 | 40.00 | 39.52 |
| Dowanol DPM | 5.00 | 5.00 | — | 2.50 | — | — |
| MEA | 10.00 | — | — | — | — | — |
| Fragrance | 1.20 | 1.20 | 1.20 | 1.20 | 1.20 | 1.19 |
| Total | 100.00 | 100.00 | 100.00 | 100.00 | 100.00 | 100.00 |

| Component | Ex. 31 | Ex. 32 | Ex. 33 |
|---|---|---|---|
| PEG 600 | 23.30 | 25.30 | 16.50 |
| BTC 8358 | 12.50 | 12.50 | 20.00 |
| Ammonyx LO | — | — | — |
| Alfonic 810-4.5 | — | — | — |
| Tomadol 91-6 | 14.00 | 14.00 | 14.00 |
| IPA | 2.00 | — | — |
| Dowanol DPnB | 40.00 | 40.00 | 40.00 |
| Dowanol DPM | 5.00 | 5.00 | 5.00 |
| MEA | 2.00 | 2.00 | — |
| Fragrance | 1.20 | 1.20 | 1.20 |
| Colorant | — | — | 0.30 |
| Total | 100.00 | 100.00 | 100.00 |

| Component | Ex. 34 | Ex. 35 | Ex. 36 | Ex. 37 | Ex. 38 | Ex. 39 | Ex. 40 | Ex 41 |
|---|---|---|---|---|---|---|---|---|
| PEG 600 | 25.00 | 73.49 | 75.10 | 27.00 | 72.00 | 28.22 | 28.22 | — |
| Bardac 208M | — | 6.30 | 6.40 | — | — | — | — | — |
| BTC 8358 | 12.50 | — | — | 12.50 | 12.50 | 12.46 | 12.46 | 12.50 |
| Tomadol 45-7 | — | 6.90 | 7.00 | — | — | 6.98 | — | — |
| Tomadol 91-6 | 14.00 | — | — | 14.00 | 14.00 | 6.98 | 13.96 | 14.00 |
| Dowanol DPnB | 40.00 | 4.93 | 5.00 | 40.00 | — | 21.93 | 21.93 | 62.00 |
| Dowanol DPM | 5.00 | 4.93 | 5.00 | 5.00 | — | 21.93 | 21.93 | 10.00 |
| MEA | 2.00 | 1.97 | — | — | — | — | — | — |
| Fragrance | 1.20 | 1.18 | 1.20 | 1.20 | 1.20 | 1.20 | 1.20 | 1.20 |
| Dye | 0.30 | 0.30 | 0.30 | 0.30 | 0.30 | 0.30 | 0.30 | 0.30 |
| Total | 100.00 | 100.00 | 100.00 | 100.00 | 100.00 | 100.00 | 100.00 | 100.00 |

| Component | Ex. 42 | Ex. 43 | Ex. 44 | Ex. 45 | Ex. 46 | Ex. 47 | Ex. 48 | Ex. 49 |
|---|---|---|---|---|---|---|---|---|
| BTC 8358 | 12.50 | 12.50 | 12.50 | 12.50 | 12.50 | 12.50 | 12.50 | 12.50 |
| Alfonic 810-4.5 | — | — | — | 14.00 | 14.00 | — | — | 14.00 |
| Tomadol 91-6 | 14.00 | 14.00 | 14.00 | — | — | 14.00 | 14.00 | — |
| Dowanol DPnB | 72.00 | — | — | 42.00 | 36.00 | 62.00 | 36.00 | 62.00 |
| Dowanol PnB | — | 62.00 | 72.00 | — | — | — | — | — |
| Dowanol DPM | — | — | — | 30.00 | 36.00 | 10.00 | 36.00 | 10.00 |
| Dowanol PM | — | 10.00 | — | — | — | — | — | — |
| Fragrance | 1.20 | 1.20 | 1.20 | 1.20 | 1.20 | 1.20 | 1.20 | 1.20 |
| Dye | 0.30 | 0.30 | 0.30 | 0.30 | 0.30 | 0.30 | 0.30 | 0.30 |
| Total | 100.00 | 100.00 | 100.00 | 100.00 | 100.00 | 100.00 | 100.00 | 100.00 |

| Component | Ex. 50 | Ex. 51 | Ex. 52 | Ex. 53 |
|---|---|---|---|---|
| BTC 8358 | 12.50 | 12.50 | 12.50 | 1.482 |
| Alfonic 810-4.5 | 14.00 | 14.00 | 14.00 | 1.50 |
| Dowanol DPnB | 36.00 | 72.00 | 67.00 | 20 |
| Dowanol DPM | 36.00 | — | 5.00 | 64.42 |
| IPA | — | — | — | 12 |
| Fragrance | 1.20 | 1.20 | 1.20 | 0.60 |
| Dye | 0.30 | 0.30 | 0.30 | — |
| Total | 100.00 | 100.00 | 100.00 | 100.002 |

| Component | Ex. 54 | Ex. 55 | Ex. 56 | Ex. 57 | Ex. 58 | Ex. 59 | Ex. 60 |
|---|---|---|---|---|---|---|---|
| Dowanol PnB | 45 | 45 | 75 | — | 60 | 31.09 | — |
| Dowanol PnP | — | — | — | — | — | 31.09 | 93.27 |
| Dowanol DPnB | — | — | — | 75 | 15 | — | — |
| Dowanol PM | 30 | 30 | — | — | — | 31.09 | — |
| Barquat MS100 | 2.42 | 2.42 | 2.5 | 2.5 | 2.5 | — | — |
| Catigene T50 | — | — | — | — | — | 2.00 | 2.00 |
| Emulgen MS-110 | 7 | — | — | — | — | — | — |
| Propylene glycol | 12.38 | 12.38 | 9.18 | 9.18 | 9.18 | — | — |
| Neodol 91-8 | — | 7 | — | — | — | — | — |
| Neodol 91-6 | — | — | 7 | 7 | 7 | 3.08 | 3.08 |
| MEA | 2 | 2 | 2 | 2 | 2 | — | — |

TABLE 1-continued

| Fragrance | 1.2 | 1.2 | 4.32 | 4.32 | 4.32 | 1.65 | 1.65 |
|---|---|---|---|---|---|---|---|
| Component | Ex. 61 | Ex. 62 | Ex. 63 | Ex. 64 | Ex. 65 | Ex. 66 | Ex. 67 | Ex. 68 |
| Dowanol PnB | 82.25 | 75 | 45 | 45 | 48.85 | 49.45 | 48.85 | 48.85 |
| Dowanol PM | — | — | 30 | 30 | 30 | 30 | 30 | 30 |
| Barquat MS100 | 2.5 | 2.5 | 2.5 | 2.5 | 2.5 | 2.5 | 2.5 | 2.5 |
| Emulgen MS-110 | — | — | — | 7 | 7 | 7 | — | — |
| Propylene glycol | — | 7.25 | 7.25 | 7.25 | 7.25 | 7.25 | 4.25 | 5.45 |
| Neodol 91-6 | 7 | 7 | 7 | — | — | — | 10 | 10 |
| MEA | 2 | 2 | 2 | 2 | 2 | 2 | 2 | 2 |
| Fragrance | 6.25 | 6.25 | 6.25 | 6.25 | 2.4 | 1.6 | 2.4 | 1.2 |
| Component | Ex. 69 | Ex. 70 | Ex. 71 | Ex. 72 | Ex. 73 | Ex. 74 | Ex. 75 | Ex. 76 |
| BTC 8358 | 1.13 | 1.13 | 1.13 | 1.13 | 1.13 | 1.13 | — | — |
| BTC 65 | 7.17 | 7.17 | 7.17 | 7.17 | 7.17 | 7.17 | — | — |
| Catigene T-50 | — | — | — | — | — | — | 10.76 | 21.52 |
| Ammonyx LO | 16 | 16 | 16 | 16 | 16 | 16 | — | — |
| Dowanol DPnB | 41.67 | 63.2 | 41.67 | 41.67 | 41.67 | 41.67 | — | — |
| Fragrance | 12.5 | 12.5 | 12.5 | 12.5 | 12.5 | 12.5 | 10 | 20 |
| Pluracol E600 | 21.53 | — | — | — | — | — | 50.79 | 16.58 |
| Neodol 91-8 | — | — | 21.53 | — | — | — | — | — |
| Neodol 91-6 | — | — | — | — | — | — | 18.83 | 37.66 |
| Hexylene Glycol | — | — | — | 21.53 | — | — | — | — |
| Alfonic 810-4.5 | — | — | — | — | 25.7 | — | — | — |
| Alfonic 610-3.5 | — | — | — | — | — | 25.7 | — | — |
| % water | | | | | | | 15 | 15 |
| Component | Ex. 77 | Ex. 78 | Ex. 79 | Ex. 80 | Ex. 81 | Ex. 82 | Ex. 83 | Ex. 84 |
| BTC 8358 | 1.35 | 1.35 | 6.46 | 6.46 | 6.46 | 6.46 | — | — |
| BTC 65 | 8.60 | 8.60 | — | — | — | — | 10.76 | 10.76 |
| Ammonyx LO | 15.70 | 13.57 | 21.43 | 19.71 | — | 13.34 | 12.03 | |
| Praepagen HY | — | 2.00 | — | 2.00 | 25.00 | — | 2.00 | 16.03 |
| Dowanol DPnB | 50.00 | 50.00 | 50.00 | 50.00 | 50.00 | 50.00 | 50.00 | 50.00 |
| Fragrance | 10 | 10 | 10 | 10 | 10 | 10 | 10 | 10 |
| Alfonic 810-4.5 | 14.35 | 14.48 | 12.11 | 11.83 | 8.54 | 15.9 | 15.21 | 13.21 |
| % water | 15 | 15 | 15 | 15 | 15 | 15 | 15 | 15 |
| Component | Ex. 85 | Ex. 86 | Ex. 87 | Ex. 88 | Ex. 89 | Ex. 90 | Ex. 91 | Ex. 92 |
| ETC 8358 | 1.17 | 1.17 | 1.17 | 1.17 | — | — | — | — |
| ETC 65 | 7.45 | 7.45 | 7.45 | 7.45 | — | — | — | — |
| Barquat MS100 | — | — | — | — | 10.00 | 6.00 | 5.00 | — |
| Catigene T50 | — | — | — | — | — | — | — | 4.80 |
| Ammonyx LO | 15.70 | 15.70 | 15.70 | 15.70 | — | — | — | — |
| Monoethanolamine | | 1.00 | 5.00 | 10.00 | — | — | — | — |
| Dowanol DPnB | 43.00 | 42.00 | 38.00 | 33.00 | — | — | — | — |
| Fragrance | 8.68 | 8.68 | 8.68 | 8.68 | 9 | 6.00 | 4.50 | — |
| Dye | — | — | — | — | — | — | — | 12.00 |
| Pluracol E600 | — | — | — | — | 28.50 | 53. | 64.25 | 86.445 |
| Neodol 91-6 | — | — | — | — | 52.5 | 35.00 | 26.25 | 7.40 |
| Bitrex (21.5%) | — | — | — | — | — | — | — | 0.005 |
| Alfonic 810-4.5 | 24.00 | 24.00 | 24.00 | 24.00 | — | — | — | |
| % water | | | | | 0 | 0 | 0 | 2.4 |
| Component | Ex. 93 | Ex. 94 | Ex. 95 | Ex. 96 | Ex. 97 | Ex. 98 | Ex. 99 | Ex. 100 |
| Catigene T50 | 4.80 | 4.80 | 4.00 | 4.00 | 3.20 | 4.00 | 4.00 | 4.00 |
| Praepagen HY | — | — | 1.00 | 3.00 | 1.00 | — | — | — |
| Fragrance | 1.20 | 0.40 | 1.20 | 1.20 | 1.20 | 1.20 | 1.20 | — |
| Dye | 0.15 | 0.15 | — | — | — | — | 0.15 | — |
| Pluracol E600 | 85.45 | 86.25 | 74.40 | 73.60 | 74.80 | 74.80 | 74.80 | 75.60 |
| Neodol 91-6 | 8.40 | 8.40 | 7.00 | 7.00 | 7.00 | 7.00 | 7.00 | 7.00 |
| % water | 2.4 | 2.4 | 15 | 15 | 15 | 15 | 15 | 15 |
| Component | Ex. 101 | Ex. 102 | Ex. 103 | Ex. 104 | Ex. 105 | Ex. 106 | | |
| Catigene T50 | 8.00 | 8.00 | 8.00 | 8.00 | 8.00 | 8.00 | | |
| Fragrance | — | 2.40 | 0.80 | 2.40 | 2.40 | 2.40 | | |
| Pluracol E600 | 67.00 | 64.60 | 66.20 | 70.60 | 50.60 | 25.60 | | |

TABLE 1-continued

| | | | | | | |
|---|---|---|---|---|---|---|
| Neodol 91-6 | 14.00 | 14.00 | 14.00 | 8.00 | 28.00 | 53.00 |
| % water | 15 | 15 | 15 | 15 | 15 | 15 |
| Component | Ex. 107 | Ex. 108 | Ex. 109 | Ex. 110 | Ex. 111 | Ex. 112 |
| Catigene T50 | 8.00 | 2.00 | 2.00 | 2.00 | 2.00 | 3.00 |
| Fragrance | 2.40 | 0.60 | 0.60 | 0.60 | 0.60 | 0.90 |
| Pluracol E600 | 12.60 | 76.40 | 38.40 | 19.40 | 10.40 | 72.10 |
| Neodol 91-6 | 66.00 | 7.00 | 45.00 | 64.00 | 73.00 | 10.50 |
| % water | 15 | 15 | 15 | 15 | 15 | 15 |
| Component | Ex. 113 | Ex. 114 | Ex. 115 | Ex. 116 | Ex. 117 | Ex. 118 |
| Catigene T50 | 3.00 | 3.00 | 3.00 | 4.00 | 4.00 | 4.00 |
| Fragrance | 0.90 | 0.90 | 0.90 | 1.20 | 1.20 | 1.20 |
| Pluracol E600 | 36.10 | 18.00 | 9.00 | 67.80 | 33.80 | 17.80 |
| Neodol 91-6 | 46.50 | 64.60 | 73.60 | 14.00 | 48.00 | 64.00 |
| % water | 15 | 15 | 15 | 15 | 15 | 15 |
| Component | Ex. 119 | Ex. 120 | Ex. 121 | Ex. 122 | Ex. 123 | Ex. 124 |
| Catigene T50 | 4.00 | 8.00 | 4.00 | 8.00 | 4.00 | 8.00 |
| Fragrance | 1.20 | 9.00 | 9.00 | 6.00 | 6.00 | 4.50 |
| Pluracol E600 | 9.8 | 8.50 | 8.50 | 39.00 | 39.00 | 54.25 |
| Neodol 91-6 | 72.00 | 63.50 | 65.50 | 41.00 | 43.00 | 29.75 |
| % water | 15 | 15 | 15 | 15 | 15 | 15 |

The above formulations are then placed into either thermoformed or injection molded water soluble containers using the methods described above. The water soluble containers showed no very little or no migration of liquid.

The components of the compositions set forth in the above Table 1 are described in Table 2 below. The indicated weight percentages are "as supplied" with the percent actives shown in parenthesis (unless otherwise noted, percent active is 100%).

TABLE 2

| Component | |
|---|---|
| PEG 600 or Pluracol E600 | Polyethylene glycol (molecular weight 600) (BASF) |
| Bardac 208M | Mixture of N,N-dialkyl($C_8$–$C_{10}$)-N,N-dimethylammonium chloride and N-alkyl($C_{12}$–$C_{16}$)-N,N-methyl-N-benzylammonium chloride (80% active; Lonza) |
| Tomadol 45-7 | linear $C_{14-15}$ alcohol with 7 moles of ethylene oxide (Tomah) |
| Tomadol 91-6 | linear $C_{9-11}$ alcohol with 6 moles of ethylene oxide (Tomah) |
| IPA | Isopropanol |
| Dowanol PnB | Propylene Glycol n-Butyl Ether (Dow) |
| Dowanol PM | Propylene Glycol Methyl Ether (Dow) |
| MEA | Monoethanolamine |
| Fragrance | Fragrance |
| Colorant | proprietary composition |
| BTC 8358 | N-alkyl (50% $C_{14}$; 40% $C_{12}$; 10% $C_{16}$) dimethyl benzyl ammonium chloride (80% active; Stepan) |
| BTC 65 | N-alkyl (67% $C_{12}$; 25% $C_{14}$; 7% $C_{16}$; 1% $C_8$, $C_{10}$, $C_{18}$) dimethyl benzyl ammonium chloride (50% active; Stepan) |
| Praepagen HY | N-alkyl ($C_{12-14}$) dimethyl 2-hydroxyethyl ammonium chloride (Clariant) |
| Dowanol DPnB | Dipropylene Glycol n-Butyl Ether (Dow) |
| Dowanol DPM | Dipropylene Glycol Methyl Ether (Dow) |
| Hexylene Glycol | Hexylene glycol |
| Dye | Dye |
| Alfonic 810-4.5 | $C_8$–$C_{10}$-alcohol polyethylene glycol ethers (4.5 EO) (Sasol North America Inc.) |
| Alfonic 610-3.5 | $C_6$–$C_{10}$-alcohol polyethylene glycol ethers (3.5 EO) (Sasol North America Inc.) |
| Ammonyx LO | Lauryl dimethyl amine oxide (30% active; Stepan) |
| Emulgen MS-110 | $C_{12}$–$C_{14}$(EO/PO/EO) nonionic surfactant (Kao) |
| Propylene glycol | Propylene glycol |
| Neodol 91-6 | $C_9$–$C_{11}$ ethoxylated alcohol having about 6 ethoxy groups per molecule (Shell) |
| Neodol 91-8 | $C_9$–$C_{11}$ ethoxylated alcohol having about 8 ethoxy groups per molecule (Shell) |

TABLE 2-continued

| Component | |
|---|---|
| Barquat MS100 | N-Alkyl($C_{12-16}$)-N,N-dimethyl-N-benzylammonium chloride (Lonza) |
| Catigene T50 | Mixture of alkyl dimethyl benzyl ammonium chlorides (50% Active; Stepan Europe) |

Certain of the concentrate compositions described on Table 1 were evaluated with respect to their cleaning efficacy as well as their antimicrobial efficacy.

A concentrate composition described as Ex.32

Evaluation of Cleaning Efficacy:

Two concentrate compositions according to the invention, (Ex. 31, Ex.32) described above were evaluated for their cleaning efficacy on tile surfaces utilizing one or both of the following protocols. "Standard soiled tiles" were prepared for use in the tests. These were prepared in accordance with the protocol described in ASTM 4488-87, Annex A2 "Greasy Soil/Painted Masonite Wallboard Test Method" as well as Annex A5 "Particulate and Oily Soil/Vinyl Tiles Test Method". Evaluation was performed utilizing a Gardner Washability Apparatus, using a standard soil tiles prepared in accordance with the protocol described above at a standard pressure and sponge stroke settings in order to determine or quantify the cleaning efficiency of the formulations. These formulations were used formed into a cleaning composition wherein 1 part of the concentrate composition described on Table 1 diluted with 64 parts water. In determining the cleaning efficiency of each of the formulations, reflectance values were determined using a Minolta Chromameter where each tile was measured three times and the mean reflectance values were used. Testing was performed for each of the following: a clean unsoiled tile, a soiled tile, and a soiled tile following Gardner Washability Apparatus scrubbing. Such reflectance values were then employed to calculate cleaning efficiency according to the following formula:

$$\%\ \text{soil removal} = \frac{Lt - Ls}{Lo - Ls}$$

wherein:

Lt=reflectance average after scrubbing solid tile;

Ls=reflectance average before cleaning soiled tile;

Lo=reflectance average original tile before soiling.

The resultant % soil removal, as well as the average value for the complete set of tiles in each sample set are reported on the following Table 3 according to the protocol of ASTM 4488-87, Annex A2, "Greasy Soil/Painted Masonite Wallboard Test Method".

TABLE 3

| Tile# | Lo | Ls | Lt | % soil removal | average |
|---|---|---|---|---|---|
| | | | Ex. 31 | | |
| 1 | 95.49 | 22.27 | 77.14 | 74.94 | 61.46 |
| 2 | 95.49 | 22.16 | 68.69 | 63.50 | |
| 3 | 95.49 | 22.69 | 66.18 | 59.74 | |
| 4 | 95.49 | 22.05 | 64.27 | 57.49 | |
| 5 | 95.49 | 24.01 | 65.54 | 58.10 | |

TABLE 3-continued

| Tile# | Lo | Ls | Lt | % soil removal | average |
|---|---|---|---|---|---|
| 6 | 95.49 | 26.20 | 64.92 | 55.88 | |
| 7 | 95.49 | 26.56 | 64.64 | 55.24 | |
| 8 | 95.49 | 27.33 | 67.11 | 58.36 | |
| 9 | 95.49 | 25.79 | 70.24 | 63.77 | |
| 10 | 95.49 | 20.97 | 71.31 | 67.55 | |
| | | | Ex. 32 | | |
| 1 | 95.49 | 22.27 | 71.87 | 67.74 | 63.83 |
| 2 | 95.49 | 22.10 | 64.63 | 57.95 | |
| 3 | 95.49 | 24.62 | 62.66 | 53.68 | |
| 4 | 95.49 | 24.01 | 69.98 | 64.31 | |
| 5 | 95.49 | 28.89 | 74.99 | 69.22 | |
| 6 | 95.49 | 25.46 | 70.70 | 64.60 | |
| 7 | 95.49 | 20.97 | 72.66 | 69.36 | |
| 8 | 95.49 | 22.09 | 68.92 | 63.80 | |

As can be seen from the results of Table 3, the diluted concentrate compositions according to the invention provided good cleaning efficacy.

A 1:64 dilution of the concentrate composition according to Ex. 32 was evaluated in accordance with ASTM 4488-87, Annex A5 "Particulate and Oily Soil/Vinyl Tiles Test Method" using the apparatus and evaluative technique described above. The results are reported on Table 4, following.

TABLE 4

| Tile# | Lo | Ls | Lt | % soil removal | average |
|---|---|---|---|---|---|
| | | | Ex. 32 | | |
| 1 | 93.76 | 60.36 | 78.57 | 54.52 | 59.73 |
| 2 | 93.78 | 57.81 | 79.84 | 61.25 | |
| 3 | 93.71 | 55.65 | 78.91 | 61.11 | |
| 4 | 93.94 | 56.74 | 79.81 | 62.02 | |

As can be seen from the results of Table 4, the diluted concentrate compositions according to the invention provided good cleaning efficacy.

Evaluation of Antimicrobial Efficacy:

The concentrate composition described as Ex. 33 of Table 1 contained in a PVOH pouch were diluted in 945 mL of water to form a 1:64 dilution of concentrate:water which was evaluated for its antimicrobial efficacy against: *Salmonella choleraesuis* (ATCC 10708), *Staphylococcus aureus* (ATCC 6538), *Pseudomonas aeruginosa* (ATCC 15442) and *Enterobacter aerogenes* (ATCC 13048). Antimicrobial efficacy was evaluated according to the protocols outlined in US EPA Pesticide Assessment Guidelines Subdivision G: Product Performance 91-2(f) Products for Use on Hard Surfaces, evaluated for a 30 second contact time. Sample dilutions of the concentrate composition was evaluated against five samples of each of the above identified challenge organisms, and the average log reduction is reported on Table 5.

TABLE 5

| challenge organism | (averaged) Log reduction |
|---|---|
| *Enterobacter aerogenes* | >4.37 |
| *Staphylococcus aureus* | >5.50 |
| *Salmonella choleraesuis* | >5.68 |
| *Pseudomonas aeruginosa* | >5.28 |

The tested dilutions of the concentrate compositions demonstrate good antimicrobial efficacy against the challenge organisms.

The invention claimed is:

1. A water soluble container containing a composition comprising:

(a) 0.01 to 20% wt. of at least one cationic surfactant having germicidal properties;

(b) at least one non-ionic surfactant;

(c) at least one organic solvent having a solubility in water of at least 4% wt.;

(d) at least one alkanolamine;

(e) at least one polyethylene glycol which is different than component (c); and (f) optionally, up to about 10% wt. of one or more conventional additives selected from coloring agents, fragrances and fragrance solubilizers, viscosity modifying agents, other surfactants, other antimicrobial/germicidal agents, pH adjusting agents and pH buffers including organic and inorganic salts, optical brighteners, opacifying agents, hydrotropes, antifoaming agents, enzymes, anti-spotting agents, anti-oxidants, preservatives, and anti-corrosion agents;

wherein said composition contains no more than 20% wt. water.

2. The container according to claim 1 which comprises a thermoformed or injection molded water soluble polymer.

3. The container according to claim 2 wherein the water soluble polymer is poly(vinyl alcohol).

4. The container according to claim 1 wherein (b) at least one non-ionic surfactant is present in an amount of from about 0.01 to about 40 percent by weight.

5. The container according to claim 1 wherein (c) at least one organic solvent is present in an amount of from about 5 to about 97 percent by weight.

6. The container according to claim 1 wherein the (d) at least one alkanolamine is present in an amount of from about 0.01 to about 15 percent by weight.

7. The container according to claim 1 wherein the (e) at least one polyethylene glycol is present in an amount of from about 2 to about 75 percent by weight.

8. The container according to claim 1 wherein the concentrate composition contains no more than 15% wt. water.

9. The container according to claim 1 wherein the concentrate composition contains no more than 3% wt. water.

10. The container according to claim 1 wherein the concentrate composition contains no more than 1% wt. water.

11. A method of preparing a dilute treatment composition comprising placing a water soluble container according to claim 1 into an amount of water within a further container, and allowing the said water soluble container to at least partially dissolve and thereby release its contents to the water within said further container.

12. A process for treating a hard surface wherein the presence of undesired microorganisms are suspected, comprising the process steps of:

placing a water soluble container according to claim 1 into a quantity of water within a further continer allowing the water soluble container to dissolve in the water present in said further container to form a dilute treatment composition;

and, applying an effective amount of the diluted treatment composition to the surface in need of treatment in order to provide sanitizing or disinfecting effect thereto.

* * * * *